United States Patent [19]

McCready

[11] Patent Number: 4,855,027

[45] **Date of Patent: * Aug. 8, 1989**

[54] CARBOSIL ANODES

[76] Inventor: David F. McCready, P.O. Box 1971, Altoona, Pa. 16603

[ * ] Notice: The portion of the term of this patent subsequent to Mar. 3, 2004 has been disclaimed.

[21] Appl. No.: 19,431

[22] Filed: Feb. 26, 1987

Related U.S. Application Data

[63] Continuation-in-part of Ser. No. 880,875, Jul. 1, 1986, abandoned, Continuation-in-part of Ser. No. 817,656, Oct. 1, 1985, Pat. No. 4,647,353.

[51] Int. Cl.[4] ..... C23F 13/02

[52] U.S. Cl. ..... 204/196; 204/147; 204/286; 204/297 R; 204/294

[58] Field of Search ..... 204/147, 148, 196, 197, 204/286, 297 R, 294

[56] References Cited

U.S. PATENT DOCUMENTS

| | | | |
|---|---|---|---|
| 2,776,940 | 1/1957 | Oliver | 204/196 |
| 2,856,342 | 10/1958 | Van Der Hoeven et al. | 204/197 |
| 2,870,074 | 1/1959 | Parker | 204/98 |
| 3,012,958 | 12/1961 | Vixler | 204/197 |
| 3,151,050 | 9/1964 | Wilburn | 204/147 |
| 3,377,150 | 4/1968 | Corley et al. | 204/294 |
| 3,410,772 | 11/1968 | Geld et al. | 204/147 |
| 3,498,898 | 3/1970 | Bogart et al. | 204/147 |
| 3,616,421 | 10/1971 | Mackintosh | 204/197 |
| 3,632,444 | 1/1972 | Grotheer et al. | 204/294 |
| 3,689,395 | 9/1972 | Blount et al. | 204/148 |
| 3,868,313 | 2/1975 | Gay | 204/196 |
| 3,893,903 | 7/1975 | Lindholm | 204/197 |
| 3,933,613 | 1/1976 | Turner | 204/286 |
| 4,133,735 | 1/1979 | Afromowitz et al. | 204/406 |
| 4,226,694 | 10/1980 | Baboian et al. | 204/196 |
| 4,647,353 | 3/1987 | McCready | 204/147 |

FOREIGN PATENT DOCUMENTS 1227405 4/1971 United Kingdom .

*Primary Examiner*—T. Tung
*Attorney, Agent, or Firm*—James C. Wray

[57] ABSTRACT

An anode for cathodic protection having a composition of carbon, silica gel and inert binders. The anode may be mounted on a surface by an adhesive and may be separated from the surface by an insulation layer. A plastic threaded fastener may be used to attach an electrical lead to the anode, and a capsule may be provided to cover the anode.

27 Claims, 4 Drawing Sheets

CARBOSIL ANODES

This is a continuation-in-part of application No. 880,875, filed July 1, 1986, now abandoned, which was a continuation-in-part of application No. 817,656 filed Oct. 1, 1985 Jan. 10, 1986, now U.S. Pat. No. 4,647,353 by David McCready.

BACKGROUND OF THE INVENTION

The invention relates to automotive cathodic protection devices and more in particular to the structure of the anodes used to impress a current within the automotive body.

Automobiles of all types must be able to cope with varying degrees of inclement weather. When moisture increases, protective measures against automobile body corrosion should be intensified. Extant carbon anodes which are used in cathodic protective systems are deficient in the ability to respond to varying degrees of moisture. What is needed in the art is a carbon anode which can respond to varying degree of atmospheric moisture so that as humidity increases conductivity to protected surfaces also increases.

SUMMARY OF THE INVENTION

The invention is essentially a composite carbon anode for use in automotive cathodic protection devices which means for attaching it to a car body and effecting good electrical conductivity therewith. The composite material is deemed carbosil which reflects the carbon and silica gel components.

One of the most salient features of the invention is the anode's ability to respond to variations in humidity. It should be appreciated that as humidity increases protection against corrosive forces should also increase. The invention provides an anode which is responsive to variations in humidity such that as humidity increases the electrical conductivity between the anode and the car surface also increases.

A preferred embodiment as described in applications Nos. 817,656 and 880,875 for an anode apparatus for use in automotive cathodic protection devices comprises a layer of insulation liquid spread upon a bare metal surface. This bare metal surface should have a hole extending therethrough for receiving a fastener. The substantially carbon anode then is mounted on this layer. The anode also has a hole extending therethrough which is to be aligned with the hole on the surface. An electrical lead is then attached to the anode by way of a ring connector. The ring is held in alignment with the holes through which a plastic threaded fastener is inserted and secured on another side of the surface with a plastic nut. The plastic threaded fastener and nut are preferred to be made of plastic such as a nylon or polyamide. This is so that if overtightening occurs the nut will strip before the anode is crushed.

The preferred anode is composed of sintered materials wherein about 90–99% of the material is carbon and preferably 98% is carbon. About 1–9% is silica gel and preferably 2% is silica gel. About 0.1–1% is inert binders and preferably less than 1% is inert binders.

The insulation liquid comprises about 41% $H_2O$, about 24% polyvinyl acetate-acrylic resin, about 23% calcium silicate pigment, about 4% sodium silicate stabilizer, about 3% of a 10% solution of $H_2PO_3$, about 3% of a 10% solution of tannic acid, about 1.5% glycol esters and about 0.5% inert material.

The preferred anode is about 5/16 of an inch thick.

The method as described in application No. 817,656 for attaching the inventive anode to the car body for use with automotive cathodic protection devices comprises relatively few steps. One merely bares a patch of metal surface and spreads a layer of the insulation liqiud over this bare metal surface. A hole is made on said surface which extends through the surface for attaching purposes. The carbon anode is then placed on this layer. An electrical lead having a ring connector is then attached to the exposed surface of the anode by way of a plastic threaded fastener inserted through the ring connector, the anode and the surface. The threaded fastener is held fast by way of a plastic nut.

An insulation liquid is used on any previously painted metal surface as follows: first the painted surface is removed in an area approximately the same size as the anode. The insulation liquid is spread upon the bare metal to form a jointure between the paint coat and itself prior to fixing the anode to the insulation liquid prepared area. The insulation liquid will supply a predictable and uniform dielectric reference point. The bonding of the anode to the metal surface is by a Nylon screw/nut attachment and/or by Isotac brand adhesive acrylic pressure sensitive double sided tape preferably #Y9469 manufactured by 3M.

It is desirable to use an adhesive such as A-10 "Isotac" Brand Adhesive which is a very firm acrylic pressure-sensitive system. It features very high ultimate bond strength, excellent high temperature and solvent resistance, and excellent shear holding power. Bond strength increases substantially with natural aging.

In one preferred embodiment the paint is cleaned of dirt, dust and wax and/or paint area. A release coating is removed from one side of an anode and the sticky face is pressed against the cleaned surface.

The present invention requires that the ferrous metal surface to be protected be totally precoated with paint as it is presented for consumer use by an automobile manufactuer. The factory painted coating acts as the dielectric barrier between the cathodically protected ferrous metal and the positively charged Carbosil anode. The positively charged anode creates a capacitance between itself and the negatively charged ferrous metal autobody. Electron flow will take place only at breaks or holidays in the painted coating. The coating flow at these holidays provides the free electron source that cathodically protects the iron from oxidation by interfering with the rusting process. The anode is bonded to the factory coating as supplied by the manufacturer through the use of an insulation fluid and/or isotac tape and dielectric Nylon screw/nut system. The carbosil anode being sensitive to moisture becomes damp and responsive to ambient moisture. The moisture in close proximity or adjacent to the painted metal surface carries the discharging electrons only through breaks or holidays in the coating. The Carbosil anode's response to moisture facilitates the current flow over the path of least resistance where moisture is greatest.

The present invention requires that the anode always makes physical contact with the painted automobile body. Changes of resistance at the anode are effected by moisture. The greater the moisture, the greater the conductivity, therefore responding directly to increases of corrosion severity with greater current flow. Conversely during very dry periods in the absence of moisture, no electrical current response is needed or produced. In no case will current flow unless a holiday exists in the coating permitting current leakage between the negative ferrous body metal and the carbosil anode. Some anode installations are improved by the use of the Isotac tape described earlier.

In one embodiment of the invention the anode may be attached with the adhesive preferably in the form of a double sided tape directly to the painted surface of an automobile. Alternately, adhesive may be used as a layer coating bare or primed metal.

In a further preferred alternative, the adhesive may attach the anode to an insulation layer as described herein.

It is an object of this invention to improve automobile cathodic protection devices by providing novel anode compositions.

It is another object of this invention to provide an anode responsive to variations in humidity.

It is another object of this invention to provide an anode which increases electrical conductivity with metal surfaces in response to increases in humidity.

It is another object of this invention to increase the longevity of automobile bodies.

It is another object of the invention to provide encapsulated anodes.

These and other and further objects and features of the invention are apparent in the disclosure which includes the above and below specification and claims and drawings.

DESCRIPTION OF THE PREFERRED EMBODIMENT

Figure 1:
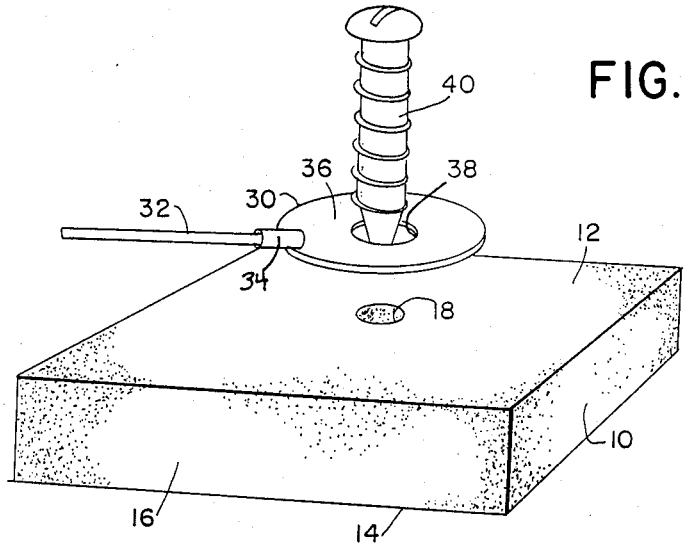
FIG. 1 is an elevated exploded perspective of one embodiment of the invention.

The preferred embodiment is a carbon anode with accompanying means for attachment to be used with automotive cathodic protection devices. The preferred embodiment is of the impressed-current protection device type.

When iron and other metals are placed in contact with electrolytes (water and dissolved salts from road de-icers, industrial pollution, etc.), they take on a force that desires release. This force causes the metal to dissolve into the surrounding electrolyte, after which the metals usually combine with oxygen to form oxides (rust corrosion). This is simply the action of metals returning to their most natural state.

Corrosion is a continuous electrical chemical process resulting in the destruction of metals. This corrosion is a direct result of an electrical current caused by the reaction between metal surfaces and existing chemicals found on and about vehicles. These chemicals, referred to as salts, form when substances in the road de-icing agents and industrial air pollutants combine with the atmosphere to produce active electrolytes such as $H_2SO_4$ (common battery acid), HCl, $HNO_3$ and a wide spectrum of additional electrolyte-producing chemicals. Sea spray along coastal areas is another source of destructive electrolyte-producing salts, and corrosion-inducing substances can even be present in the tap water used to wash and preserve a car's finish.

The metal components of cars produce an electrial current when differences in electrical potential exist. These differences in potential are an inherent characteristic of dissimilar metal used in automobiles construction. When an electrolyte is present, a path of electrons (electric current) will be released when the electrolye contacts alloys and bolted or welded areas of the vehicle. The effect of current flow from one portion of the metal through the electrolyte to another part of the structure causes metal ions or particles to leave the surface of the metal. As these particles separate from the structure, combining with the electrolyte, pits develop. These pits act as miniature galvanic (battery) cells. As this electrical chemical process continues, the cells grow larger and larger with the end result being the ultimate destruction of the metal. The rate of this naturally occurring current flow determines the life of the metal. For instance, one ampere of current discharge from iron is sufficient to remove 20.2 pounds of metal in a single year.

With steel, rust is solid evidence of corrosion. Rust has the same chemical composition as hematite, the most common form of iron ore. Steel mills use large amounts of energy to drive off oxygen in converting ore to steel. The reverse process is fairly passive because steel is eager to reunite with oxygen and revert back to its original state as an oxide of iron.

For metal to corrode there must be an anode, a cathode, and an electrolyte with available oxygen (usually damp earth or water). There must also be a potential difference between the anode and the cathode. These conditions set up what is called the "corrosion cell." At the anode, positively charged atoms of the metal leave the solid surface and enter the electrolyte as metallic ions. Current leaves the metal at the anode and migrates through the electrolyte to the cathode. Heat, such as is provided by sunlight, makes the reaction more efficient. This results in rust, pitting, and corrosion at the anode.

Once corrosion starts it is self-sustaining and irreversible. Age and condition of structure, coating, temperature, and other facts influence the rate of corrosion. If not controlled, corrosion, rust and pitting will continue until the metal structure is useless.

A scratch or nick in the protective coating sets the stage for rust and corrosion. When base steel is exposed to the electrolyte, the electro-chemical circuit is established. The steel gives up metallic ions to the electrolyte. A pit forms. Rust is created. The cycle is self-sustaining and will continue until the steel is consumed. Rust is formed by the uniting of the oxygen in the water and metallic ions. Many times this out-of-sight, out-of-mind process goes undetected until severe damage occurs.

A second form of corrosion, called "galvanic corrosion" happens when two dissimilar metals are in contact in the presence of an electrolyte. The metal with the higher potential becomes the anode and the one with the lower potential, the cathode. Such corrosion "cells"

rob the higher-potential metal of ions until it is consumed. Metals are listed according to potential in the electromotive, galvanic, series of metals.

From the active end to the noble or passive end there is: magnesium, aluminum, iron (ferrous), cadmium, nickel, tin, brass, copper, silver, monel, titanium, platinum, graphite, gold.

Any metal higher on the scale sacrifices itself to any metal lower on the scale when the two are in contact in the presence of an electrolyte. Such sacrifice corrosion is the basis for cathodic protection.

The very nature of galvanic corrosion offers an opportunity to use it creatively. This is done by placing expendable and replaceable metal anodes (higher in the galvanic series than steel) in contact with the submerged steel to be protected. The anodes make the entire wetted steel surface a cathode and sacrifice themselves to protect the steel. Thus corrosion is used to fight corrosion.

Another means of controlling corrosion is to reverse the corrosion cell's current flow via in impressed current. Direct current is applied to an anode made of platinum, graphite, cast iron, aluminum or other material based on economic factors. The direct current reverses the galvanic flow from the steel and converts the steel into the protected cathode.

The cathodic device reduces automotive corrosion and rust by using integrated circuitry to impress a DC current on and about the car's body and support structure. This DC current, supplied by the car's battery, impedes the process by which road salts, industrial pollutants, salt air, and acid rain eat away and destroy metal components.

The system comprising the preferred embodiment consists of a command module mounted near the vehicle operator, an interface module located under the dash, and two special electrodes mounted on the front and rear of the car's underbody.

This device fights automotive corrosion where it starts by protecting concealed underbody and frame panels as well as painted outerbody surfaces that have been chipped or scratched. The very principle from which the automotive cathodic protection systems was designed ensures that the device's electrical counteraction will work hardest on those areas most susceptible to rust and corrosion. State of the art integrated circuitry and silicon chips monitor and respond to subtle changes in humidity, temperature, and other variables affecting rust formation, so the system offers maximum protection in all types of conditions. The system is compatible with sophisticated spray-on protective materials, none of which have proven lastingly effective against corrosion. The systems can be considered a backup to any other rust-proofing method.

While no anticorrosion method can claim to be 100% effective the system when used as directed, can extend the life of a car's body by 75%. This means that the average car body life of eight years could be extended to 14 years. The dollar savings are obvious as evidenced by the potential for a much greater resale value beyond the fourth year of an automobile's life.

The only way to satisfy the electromotive forces set up by the electrolyte is to supply a readily available source of charged particles to act as current. Unfortunately, in vehicles unprotected by the system, the source of charged particles must be the metal itself, and rust and corrosion result.

The system supplies current to the electrolytes so a car's metals do not have to. Through the use of a car's battery and two strategically placed anodes, the device converts an entire car into a functioning cathode that supplies an electron flow to the entire car surface. Therefore, when a naturally occurring electrolyte creates a potential difference between metal parts of a car, the source for current flow becomes the car's battery, not its metal components. The effects of the electrolyte are disarmed by this superficial current flow, and the metal remains intact. Once the electrolyte is disarmed in this manner, rust and corrosion are drastically diminished.

Surface rust is very common in the dry and arid regions of the Southwest where the lack of rainfall and humidity prevents the formation of electrolytes. It is not uncommon to find 20 to 30 year old vehicles, mechanically worn out and abandoned, having solid bodies almost completely devoid of paint. These vehicles do not rot away with cavernous holes. Complete destruction of body panels and frame members simply does not occur because corrosion cannot begin without the presence of an electrolyte.

These vehicles have one extremely interesting point in common, i.e., their entire surface may have a red dust coating of iron oxide. This is because in areas of extremely low humidity, oxygen in the atmosphere combines with iron to produce ferric oxide hydrite, a crystalline compound that acts as a barrier against further oxidation of the iron. If an electrolyte were present, deep penetrating corrision could occur, but because of the extreme lack of moisture, oxidation ceases almost immediately. For these reasons, it is completely normal to see this extremely light coating of surface rust even when using the system.

Aside from erosion by sand and small stones abrading away body panels,all automotive corrosion is the result of the electro-chemical reaction set off by electrolytes. Poltice corrosion is a severe form of corrosion most often found in the underbody fender wells where mud, road salt, and moisture collect, forming a poltice. The salt in this poltice draws even more moisture from the atmosphere, making these areas prone to continuous corrosion action.

Stress corrosion occurs as a result of torsional effect on metal components. This torsional effect can be caused in one of two ways: (a) by the normal stress and movement of metal resulting from normal movement and vibration; or (b) by impact bending of body panels caused by external forces such as slight collisions with pebbles, other cars, or other objects. As the metal flexes, its crystalline structure gives way and releases metal ions.

Starting with a difference in potential, rust and corrosion is always the result.

Potential Difference. A potential difference is unavoidably built into steel during its manufacture. When steel is exposed to an electrolyte and oxygen, an electrochemical reaction takes place.

Temperature variations, such as sunlight on one side of a tank, can set up strong potential differences. Or, a combination of agitated and stagnant water areas is a condition that encourages corrosion.

Welds corrode fast. Heat from welding changes the potential in the weld area (charged particles of metal). These metal ions then react with the electrolyte, speeding up the corrosion process in the affected area.

Pit corrosion (described earlier) can occur whenever favorable conditions exist. But it is interesting to note that it is most active during a wetting/drying cycle, when the corrosion rate is actually enhanced and the pitting attack is most rapid. This pitting is not limited to cold weather. In fact, pitting activity increases as the temperature increases.

The real demons of rust and corrosion are electrolytes that permit electrical activity between the dissimilar metals and alloys of a car's frame and body components. The system provides the necessary electrons to disarm and render these electrolytes less active.

For corrosion in a joint a potential difference is set up between the oxygen-rich electrolyte and oxygen-starved electrolyte at the bottom of the crevice. This condition can occur at joints and welds were water is stagnant.

Pressure or stress in one area can change potential. Most times, the point of stress becomes an anode. This weakens the steel where strength is most needed. Stress points, such as bends or surface hardened areas, are good candidates for corrosion.

In the past 25 years the most common method of "rust proofing" car bodies involved spraying them with protective undercoatings. While these coatings do provide a certain amount of sound absorption and abrasion resistance, their record as corrosion inhibitors has proven less than effective. Application is difficult, and many corrosion-vulnerable areas of a car cannot be reached by even the most sophisticated spraying equipment. Furthermore, in as little as two and a half to four years, coated vehicles have shown extensive corrosion beneath the protective coating. This is because no matter how good the protective coating, electrolytes can eventually work their way through the coating to the metal below by the process of osmosis. This is why the device can serve as an effective backup to even the most respected undercoating systems.

Electrolytes can penetrate protective coatings by osmosis and attack the metal beneath. The coating will actually flake off the metal.

A car's battery is an ideal source of energy to power a cathodic protection device since it supplies direct current, the exact type of electrical current needed for this type of protection. Of course, the device does draw a small amount of power from the battery at all times, but when compared to the savings on the car's body, the wear on the battery is truly negligible. For example, under normal use (driving a car 100 or more miles per week), the battery will have sufficient opportunity to recharge. If a car is stored for 30 days without operating it, there will be an appreciable drain on the battery, but most good quality batteries will still retain enough reserve to start the engine and begin the recharging cycle. The device also incorporates a unique pulsating system that allows a battery to use its rejuvenating properties more effectively.

Cathodic protection is not new. It has been used extensively to protect underground pipelines, reinforcement bars on bridges, and ocean going vessels. Industries with high capital investment, such as petroleum, shipping, construction, and exploration, have always recognized the value of extending the useful life of their metal goods.

In the automobile industry, the incentive to extend the life of the product simply did not exist.

Reasoning that it would cut down future sales, those in the industry considered it unthinkable to build a vehicle that would last beyond ten years.

In accordance with the device described above, the invention provides carbon anodes. The composition of the anodes is about 98% carbon and about 2% silica gel, with less than 1% of the anode containing inert binders. The components are sintered, then combined homogeneously, evenly mixed, and extruded as a high density compressed mass. The material is reduced to specific anode size as required. This anode is deemed carbosil to reflect the carbon and silica nature of the composite. The carbosil anode has been designed to meet requirements of impressed current design. The dessicants, i.e., less than 5% of total composition, are sensitive to atmospheric moisture and thereby vary conductivity to protective surfaces. As the humidity increases, the associated electrolytic corrosion effect increases. In response, the carbosil anode increases the conductivity to protective surfaces. Therefore, the addition of moisture-sensitive compounds to the carbon anodes increases the distribution of current necessary to disarm the corrosive effect of the electrolyte.

The properties of the carbosil anode are:

a. Bulk Density—0.0625 lbs/cu. in.
b. Maximum Grain Size—0.035 inch
c. Specific Resistance—0.00039 ohms/in.
d. Compression Strength—5200 PSI
e. Porosity—25%
f. Tensile Strength—1800 PSI
g. Thermal Conductivity—0.25 BTU/FT$^2$ sec.F.

Referring now to FIG. 1, the anode with attaching means will be discussed with particularity. There is the anode itself 16. The sintered material is generally indicated by the numeral 10. The side of the anode which faces the car body is 14. The side of the anode to which the electrical lead attaches is 12. The threaded fastener for attaching the anode 16 to the car body is 40. It is preferred this be of a plastic or a dielectric material such as a polyamide, i.e., nylon. The electrical lead 32 has a ring connector 30 attached to the electrical lead. The ring connector has a sleeve 34 adapted to receive the lead 32. The ring 36 has a hole 38 through which threaded fastener 40 may be inserted. The hole 38 is in alignment with hole 18.

Figure 2:
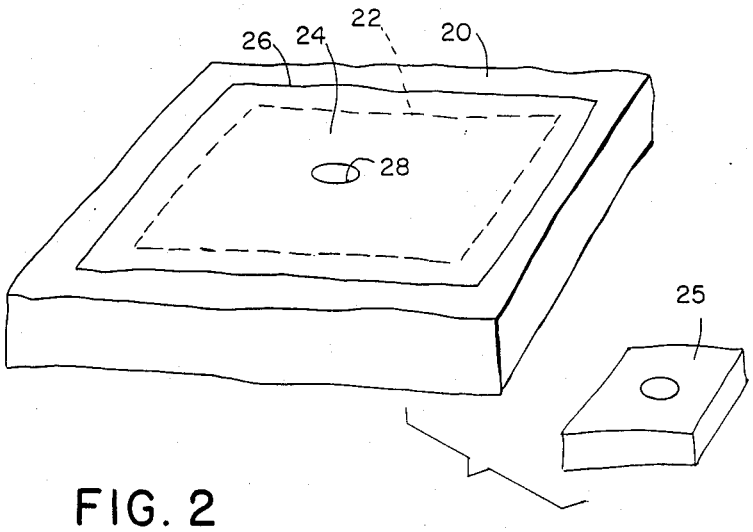
FIG. 2 is an elevated perspective of a prepared surface which would receive the embodiment of FIG. 1.

FIG. 2 depicts a section of car body. A hole 28 extends therethrough for receiving threaded fastener 40. The area encompassed by dotted line 22 represents the bare metal surface which has had paint removed from it. This surface 24, would have been the primary area of conductance if not for the insulation liquid layer previously discussed. The area encompassed by line 26 is the area which has been coated with the insulation liquid. Essentially, a surface of the metal has been cleaned free of any coating material and then has been painted, with a little bit of overlap onto coated area, with an insulation liquid material. This material comprises: 41% $H_2O$, 24% polyvinyl acetate-acrylic resin, 23% calcium silicate pigment, 4% sodium silicate stabilizer, 3% of a 10% molar solution of phosphoric acid, 3% of a 10% molar solution of tannic acid, 1.5% glycol esters and 0.5% inert material. The purpose of the fluid is to prevent the electrical conductivity of the surface 24 by acting as an insulation layer and forcing the current to travel around this insulation layer into the surrounding area.

The surface 20 on FIG. 2 is that area of the car body surface which has not been touched with the process of attaching the invention.

On a back side of surface 24 there is located a plastic dielectric nut 25 for receiving the threaded fastener 40. It is important that this nut be made of a polyamide or similar material such that when overtightening occurs the nut will strip before the anode is crushed.

Figure 3:
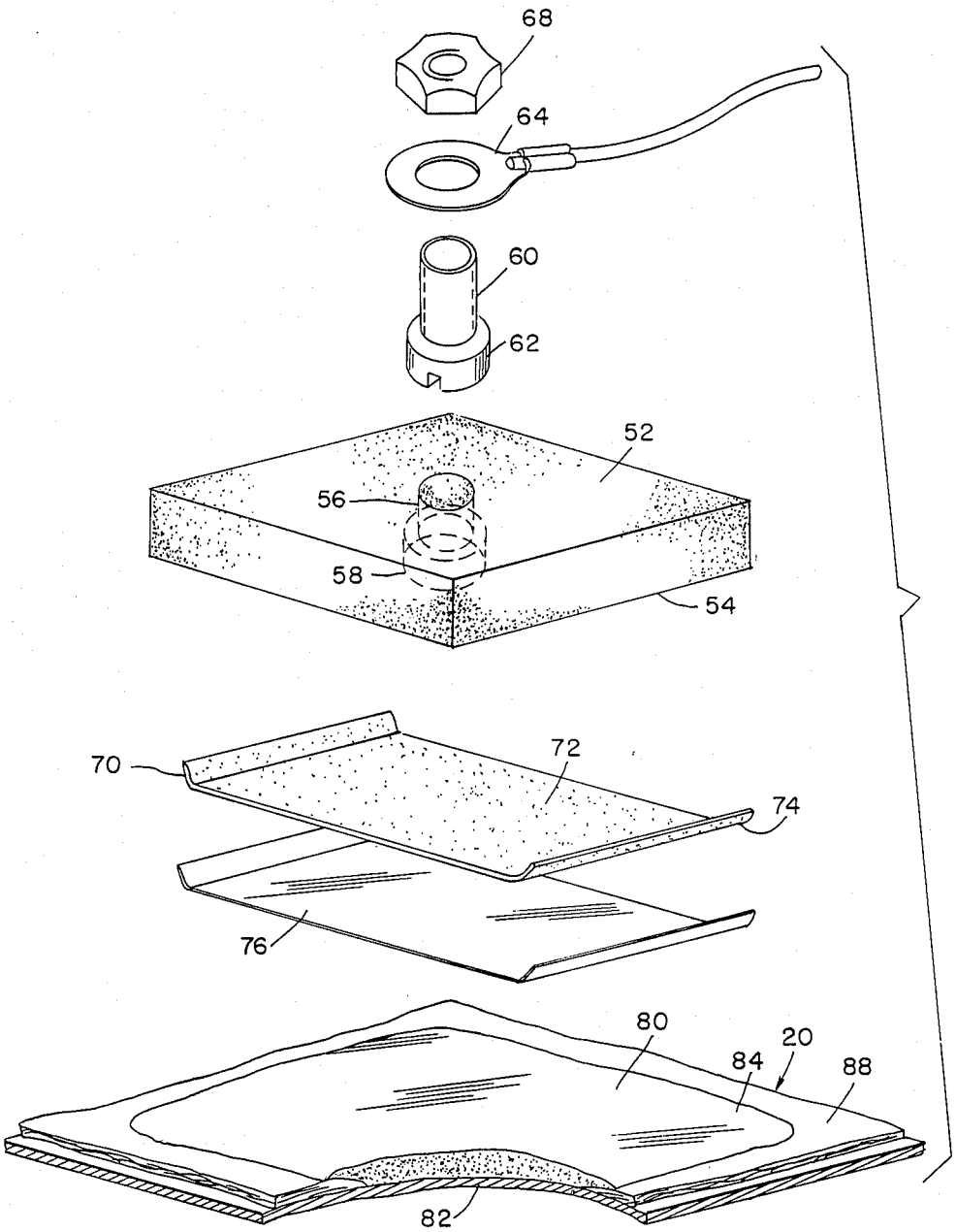
FIG. 3 shows a preferred construction attachment of a conductor to an anode on an anode to an automotive body.

A preferred form of the invention is shown in FIG. 3. An anode 50 has first and second sides 52 and 54. A hole 56 extending through the anode 50 is countersunk 58 on side 54 to receive a head 62 of a threaded plastic fastener 60, which project beyond side 52. A ring connector terminal 64 fits over fastener 60 and is held lightly against side 52 of anode 50 by a plastic nut 68. Alternatively, connector 64 may be held on surface 52 by a conductive adhesive. Alternatively, a suitably shaped connector 64 may be potted or otherwise held on the anode by any suitable means.

A double sided tape 70 has adhesive 72 and 74 on opposite sides. One side 72 is attached to side 54 of anode 50, covering the countersunk or flush head 62 of the fastener 60.

Adhesive 74 of tape 70 is covered by a conventional release sheet 76.

Adhesive 74 may be attached to an insulation layer 80 coating bared metal 82. Alternatively, adhesive 74 adheres the tape and the anode to an area such as 84 where an insulation layer covers conventional paint 20.

Alternatively, the adhesive 74 attaches the tape and the anode directly on the paint 20 such as at location 88.

Under some circumstances, an insulating capsule device may be provided for use with the carbosil anodes. These devices are shown in FIGS. 4–10.

Capsules may be used to prevent electric shock to users of the carbosil anodes as well as to protect the anodes from damage. Although unlikely, it is possible when the carbosil anode is in place and a voltage applied, that the user would touch the carbosil anode and the system ground simultaneously, thereby generating a harmless electric shock. Capsules are more appropriate on corrosion protection systems which use high voltage, but it is preferable to include a capsule in low voltage systems as well.

A carbosil anode as previously described is drilled to accept the plastic mounting screw, the head of which is recessed within a countersunk hole. The threaded portion of the screw extends upwardly and through the top of the anode and is then fitted with a ring terminal and wire.

Figure 4:
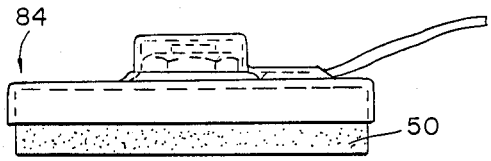
FIG. 4 is a side elevation of an anode having a capsule cover and bonded connector cap.

In the embodiment of FIG. 4, a nut secures the ring terminal and wire to an upper surface of the anode. Afterwards, the uppermost two-thirds of the anode 50 is dipped in butylstyrene to form a plastic coat or capsule 84 which is approximately 3/16 inch in thickness. As shown in FIG. 4, the capsule covers the terminal connection, nut and screw.

Figure 5:
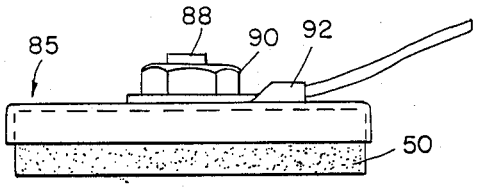
FIG. 5 is a side elevation of an anode having a cover.

In FIG. 5, a pre-formed plastic capsule 85 is assembled over the upper two-thirds of anode 50, such that screw 88 extends beyond an upper surface of the capsule to receive ring terminal 92 and nut 90. The nut 90 fastens the various components together.

Figure 6:
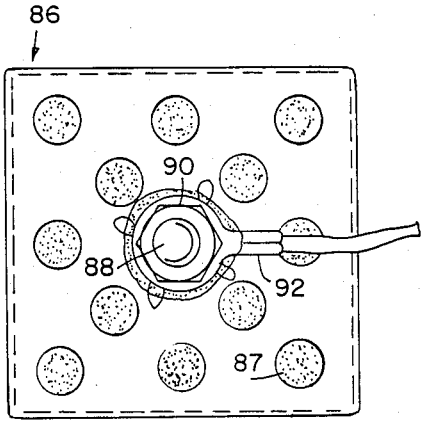
FIG. 6 is a plan view of a covered anode.
Figure 7:
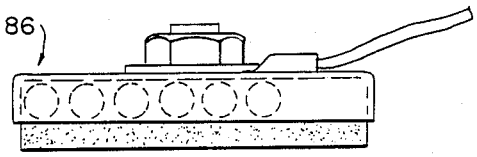
FIG. 7 is a side elevation of an anode having side moisture admitting openings.

In the embodiment of FIGS. 6 and 7, a capsule 86 is provided with a plurality of spaced openings 87 which allow moisture in the atmosphere to interact with silica gel in the anode. Capsule 87 is assembled similarly to capsule 85.

Suitable plastic materials are chosen for constructing capsules 85 and 86, and should be based on insulating properties. Polystyrene is particularly well-suited for the voltage requirements contemplated in the corrosion protection system described in this and other co-pending applications of the inventor.

Figure 8:
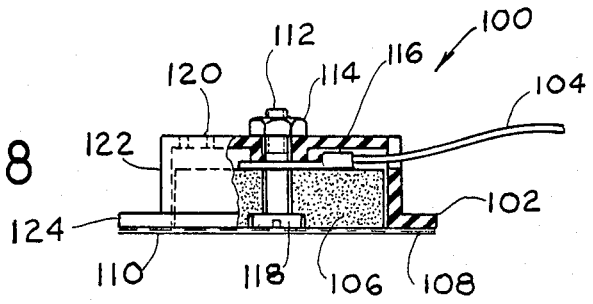
FIG. 8 is a side operation, partly in section, of an anode having another cover.
Figure 9:
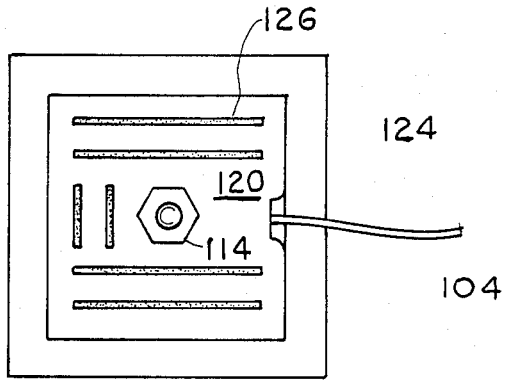
FIG. 9 is a plan view of the cover of FIG. 8.
Figure 10:
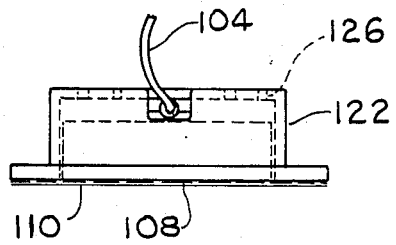
FIG. 10 is another side elevation view of the cover of FIG. 8.

A preferred capsule is shown in FIGS. 8–10 in which the capsule is made of polystyrene. The capsule 100 is provided with a flange 102 that extends around a generally rectangular body. Wire 104 passes through an opening provided through the body.

An anode 106 is enveloped by the body on five sides, and by Isotac double-sided tape 108 at the bottom. The tape 108 has one surface that adheres to the anode and the flange of the capsule. The reverse side of the Isotac tape fits the capsule/anode assembly to the subject of protection. The assembly mounting surface therefore shares a common geometric plane with the coating of the subject. The tape is preferably made 10 ml. thick of isocyanite material. The tape is commercially available from the 3 M Company. The bottom surface of the tape 108 is provided with a waxed paper sheet 110 that is peeled off when the tape is ready for connecting the assembly to the subject. Any suitable material may cover the bottom of the tape 108 so long as the material does not permanently stick to the tape.

In assembling the device, screw 112 passes through the anode 106 such that, when head 118 is received in the countersunk portion of the body, an upper threaded portion extends beyond the anode by a length sufficient to receive nut 114. First the screw received ring terminal 116 with connected wire 104. Next, the body of the capsule is fitted over the anode 106 with the screw passing through an upper surface of the body. Wire 104 passes through the side 122 of the body while ring terminal 116 is fitted between an abutment extending inwardly from an upper surface 120 of the body and an upper surface of the anode. To complete the assembly, nut 112 is secured to the screw. The screw and nut are plastic and therefore do not present a conducting surface outside the capsule. Preferably, the outer extending end of the screw is flush with the outer surface of nut 114.

The body should have a thickness 124 of between 0.070 and 0.090 inches and a dielectric strength of 5,000 volts. More or less thickness may be appropriate for materials other than polystyrene. Ventilation slots 126 allow moisture in the atmosphere to interact with silica gel of the anode. When voltage is sufficiently high, the capsule 100 prevents shock and additionally prevents damage to the anode by acting as a shield.

The arrangement of Isotac tape in the FIGS. 8–10 embodiment is similar to that shown and described with reference to FIG. 3.

As this invention may be embodied in several forms without departing from the spirit or essential characteristics thereof, the present embodiment is therefore illustrative and not restrictive, and whereas the scope of the invention is defined by the appended claims, all changes that fall within the metes and bounds of the claims or that their form their functional as well as their conjointly cooperative equivalents are therefore intended to be embraced by those claims.

What I claim is:

1. An anode apparatus for automotive cathodic protection device, comprising:

(a) an insulation layer upon a surface, wherein said layer has about equal parts of polyvinyl acetate-acrylic resin and calcium silicate pigment;
(b) an anode comprising about 90–99% carbon, about 1–9% silica gel, and about 0.1–1% inert binders, mounted on said layer and having a hole extending therethrough receiving a plastic threaded fastener;
(c) an electric lead attached to said anode, wherein said electric lead has a ring connector through which said fastener may be received, whereby said ring may be held fast to a surface of said anode;
(d) the plastic threaded fastener extending through said hole and said ring, a plastic nut receiving said threaded fastener in threaded engagement, and holding the ring on the anode, and wherein said plastic threaded fastener and nut is composed of a polyamide; and
(e) an electrically insulating capsule connected to and covering the anode.

2. The apparatus of claim 1 wherein said anode is composed of sintered material.

3. The apparatus of claim 2 wherein said anode is about 5/16th of an inch thick, and the capsule covers the top and side walls of the anode and is attached to the metal surface by a radially extending flange.

4. Corrosion protection apparatus comprising a sintered anode comprising carbon, silica gel, and binders, electrical lead having an electrical connector, first means for connecting the connector to one side of the anode, second means for connecting a second side of the anode to a surface to be protected, and a capsule covering and electrically insulating the anode.

5. The apparatus of claim 4 wherein the second means comprises an adhesive.

6. The apparatus of claim 5 wherein the adhesive is on both sides of a double sided tape.

7. The apparatus of claim 6 wherein the tape is interposed between the second side of the anode and a flange extending outwardly from a bottom of the capsule on the one side, and paint covering a surface to be protected on the other side.

8. The apparatus of claim 4 wherein the second means is a double sided adhesive tape having one side permanently connected to the second side of the anode and to a flange of the capsule, and having a second side covered by a release coating.

9. An anode apparatus for automotive cathodic protection device, comprising:
a painted metal surface;
an anode comprising about 90–99% carbon, about 1–9% silica gel, and about 0.1≧1% inert binders, mounted on said surface;
an electric lead attached to said anode, whereby said lead is held fast to said anode; and
adhesive means for holding said anode on said painted metal surface.

10. The apparatus of claim 9 further comprising a non-conducting capsule substantially covering the anode for preventing electric contact.

11. The apparatus of claim 10 wherein the capsule has a outer wall through which a dielectric fastener extends.

12. The apparatus of claim 11 wherein the capsule has a side wall through which a wire of the electric lead extends.

13. The apparatus of claim 10 wherein the capsule is provided with means for communicating moisture in the atmosphere to interact with the anode.

14. The apparatus of claim 13 wherein the communication means comprises a plurality of slots provided in an outer wall of the capsule.

15. The apparatus of claim 13 wherein the communication means comprises a plurality of openings provided in a wall of the capsule.

16. The apparatus of claim 10 wherein the capsule has a first wall covering the anode and side walls extending over the sides of the anode and a flange extending outwardly from the side walls at an end opposite the first wall, and wherein the adhesive means extends between the flange and the surface, wherein the flange supports the capsule on the metal surface, and wherein the electric lead is covered beneath the capsule.

17. The apparatus of claim 16 wherein the capsule is made of polystyrene material.

18. The apparatus of claim 10 wherein the capsule comprises a coating of butylstyrene over an upper portion of the anode.

19. The apparatus of claim 10 wherein the capsule comprises a wall covering the anode and side walls extending over a portion of the anode side walls, wherein the electric lead is connected to the anode within the capsule.

20. The apparatus of claim 9 wherein said anode is composed of sintered material.

21. The apparatus of claim 20 wherein said adhesive means comprises an adhesive coating between the sintered material anode and the painted metal surface.

22. The apparatus of claim 21 wherein said adhesive coating comprises a double sided adhesive tape stuck to the andoe and for sticking to the painted metal surface.

23. The apparatus of claim 22 wherein said tape is about 10 ml. thick.

24. The apparatus of claim 23 wherein said tape is composed of isocyanite material.

25. An anode apparatus for automotive cathodic protection devices, comprising:
(a) an adhesive layer upon a painted metal surface;
(b) an anode comprising about 90–99% carbon, about 1–9% silica gel, and about 0.1–1% inert binders, mounted on said layer;
(c) an electric lead attached to said anode; and
(d) an electrically insulating capsule connected to and covering the anode.

26. The apparatus of claim 25 wherein said anode is composed of sintered material.

27. The apparatus of claim 26 wherein said anode is about 5/16th of an inch thick, and the capsule covers the top and side walls of the anode and is attached to the painted metal surface by a radially extending flange.

* * * * *